United States Patent [19]

Sander et al.

[11] 3,960,794

[45] June 1, 1976

[54] MANUFACTURE OF AQUEOUS SUSPENSIONS OF POLYOLEFIN FIBRIDS

[75] Inventors: Bruno Sander, Ludwigshafen; Heinz Berbner, Moerlenbach; Manfred Hoffmann, Ludwigshafen, all of Germany

[73] Assignee: BASF Aktiengesellschaft, Ludwigshafen (Rhine), Germany

[22] Filed: Sept. 3, 1974

[21] Appl. No.: 502,665

[30] Foreign Application Priority Data

Sept. 13, 1973 Germany ..... 2346081

[52] U.S. Cl. ..... 260/17.3; 162/146; 162/157 R; 162/167; 260/29.4 UA; 260/67.6 R; 428/502

[51] Int. Cl.[2] ..... D21D 3/00; C08L 23/06; C08L 61/32

[58] Field of Search ..... 260/67.6 R, 17.3, 29.4 UA; 162/157 R, 167, 146; 428/502

[56] References Cited

UNITED STATES PATENTS

| | | | |
|---|---|---|---|
| 2,680,682 | 6/1954 | Dearing | 162/167 |
| 3,479,247 | 11/1969 | Bonzagni | 260/17.3 R |
| 3,501,429 | 3/1970 | Bonzagni | 260/17.3 R |
| 3,630,831 | 12/1971 | Jongetjes | 162/157 R |
| 3,721,651 | 3/1973 | Yates | 162/167 |
| 3,753,934 | 8/1973 | Diethelm et al. | 260/67.6 R |
| 3,755,220 | 8/1973 | Freimark et al. | 162/167 |

*Primary Examiner*—Murray Tillman
*Assistant Examiner*—A. H. Koeckert
*Attorney, Agent, or Firm*—Johnston, Keil, Thompson & Shurtleff

[57] ABSTRACT

A process for the manufacture of nonfoaming aqueous suspensions of polyolefin fibrids using suitable dispersing agents. These are obtained by polycondensation of 1 mole of melamine, from 1.8 to 3 moles of formaldehyde and from 0.1 to 0.5 molar portions of amino carboxylic acids or alkali metal salts thereof. Very small quantities of said dispersing agents are sufficient to finely disperse the hydrophobic polyolefin fibrids in water and to prevent the formation of foam in the manufacture of web structures of a paper-like and textile-like nature. The aqueous suspensions of polyolefin fibrids may also contain cellulose fibers.

2 Claims, No Drawings

MANUFACTURE OF AQUEOUS SUSPENSIONS OF POLYOLEFIN FIBRIDS

This application discloses and claims subject matter described in German patent application No. P 23 46 081.3, filed Sept. 13, 1973, which is incorporated herein by reference.

This invention relates to a process for the manufacture of aqueous suspensions of polyolefin fibrids by dispersing said polyolefin fibrids in water in the presence of a dispersing agent.

It is well known that polyolefin fibrids, which are hydrophobic by nature, may be dispersed in water when surfactants are used as dispersing agents. Such surfactants are generally composed of hydrophilic and hydrophobic segments, the hydrophilic properties being produced by polyethylene oxide units. The preferably terminal hydrophobic segments comprise for example polypropylene oxide units, alkyl/phenol radicals, urethane groupings or fatty alcohol radicals.

However, the use of these dispersing agents suffers from the drawback that both in the manufacture and in the processing of such aqueous suspensions of polyolefin fibrids marked foaming sometimes occurs. To counteract this, it is often necessary to use antifoaming agents in not inconsiderable amounts. It has also been found that the use of such wetting agents or the mixtures of wetting agents and antifoaming agents causes a marked reduction in the initial wet strength of paper sheets which have been made, for example, from polyethylene fibrids and cellulose fibers.

It is an object of the invention to modify the above dispersing process in such a manner that the said disadvantages no longer occur. Small amounts of the dispersing agents should provide ideal dispersion of the polyolefin fibrids in water and should cause no foaming during manufacture and processing of the suspension, particularly during processing in paper machines. The presence of such agents must not impair the bond between the synthetic fibrids and between these fibrids and cellulose fibers, if present, but rather should afford an improvement of said bond so as to give good initial wet strength of the webs.

We have now found that the above object is achieved by using dispersing agents consisting of a melamine/formaldehyde polycondensate which has been prepared by polycondensation of melamine, formaldehyde and aminocarboxylic acids or alkali metal salts thereof in aqueous solution at a molar ratio of melamine to formaldehyde of from 1:1.8 to 1:3 and using an amount of from 0.1 to 0.5 mole of aminocarboxylic acid or alkali metal salt thereof per mole of melamine, which condensate has a viscosity of from 10 to 120 centipoise in 30% w/w/ solution at 20°C.

The dispersing agents to be used in the process of the invention are prepared by polycondensation of the starting materials at temperatures of from 75° to 95°C and at pH's of from 7 to 11. The concentration is generally such that a from 30 to 60% aqueous solution of the polycondensate is obtained. The polycondensates of melamine and formaldehyde to be used in the process of the invention are prepared in the presence of aliphatic and/or aromatic aminocarboxylic acids, e.g. aminoacetic acid, o-aminobenzoic acid and ε-aminocaproic acid. We prefer to use the alkali metal salts, in particular the sodium salt, of said aminocarboxylic acids. In addition, ε-amino-carboxylic acids of from 7 to 12 carbon atoms are suitable. These are obtained, for example, by hydrolysis of the corresponding lactams.

Particularly suitable are polycondensates containing aminocarboxylic acids, in the preparation of which the molar ratio of melamine to formaldehyde is from 1:2.2 to 1:2.6 and which has a viscosity of from 10 to 150 centopoise at 20 °C in 30% w/w/ aqueous solution.

The polyolefin fibrids are manufactured in conventional manner. For example, a pressurized solution of the polyolefin is forced through a narrow orifice to be relaxed in a chamber containing either a gaseous medium (air or nitrogen) or a liquid medium (water or an organic precipitant). In a preferred embodiment the polyolefin solution is forced through a circle of nozzles to be dispersed in a turbulent field of shear produced in an impulse exhange chamber situated downstream of the die orifices by a jet or an auxiliary gas or liquid emerging concentrically with said circle of nozzles.

In another procedure, a solution of the polyolefin is dispersed in a precipitant and the polymer is precipitated under shear.

The fibrids obtained by said process are similar to cellulose fibers in size and shape. They differ from staple fibers in that they have a relatively large specific surface area (from 1 to 80 $m^2/g$) and are capable of forming a web when deposited onto a screen from aqueous suspension.

By polyolefins we mean, in particular, polyethylene and polypropylenes. The density of the polyethylenes may be between 0.915 and 0.965 $g/cm^3$. The melt index of the polyethylenes is preferably from 0.01 to 100 g/10 min., as determined according to ASTM-D 1238-65 T at 190°C under a load of 2.16 kg. The polyethylenes are prepared by the well-known high-pressure and low-pressure polymerization processes. Copolymers of ethylene with vinyl acetate, n-butyl acrylate or acrylic acid are also suitable. Suitable polypropylenes are those having an intrinsic viscosity of from 1.5 to 8 dl/g, as measured at 130 °C in decalin.

The dispersing agents are used in the process of the invention in the form of their aqueous solution. The amount of dispersing agent used if from 0.1 to 2% and preferably from 0.3 to 1%, by weight of the dry weight of the fibrids.

The polyolefin fibrid suspensions produced in the process of the invention are prepared, for example, by transferring the hydrophobic polyolefin fibrids to a specific amount of water with stirring, this water containing the dissolved dispersing agent. The resulting pulp is then stirred for from 5 to 15 minutes with a high-speed propeller stirrer. The solids concentration is generally from 0.5 to 10% and preferably from 1 to 5%, by weight.

The resulting fibrids suspension may be diluted with water as required and then converted to paper-like or textile-like webs on a paper- or web-making machine.

Alternatively, the treated polyolefin fibrids may be isolated from the suspension by filtration under suction or pressure or by centrifuging. The separated mush of fibrids then has a water content of from 75 to 85% by weight. In this form, the fibrids are suitable for transport and storage. The fibrids prepared by the process of the invention may be redispersed in water even after relatively long periods of storage. The fiber concentration in the suspensions formed by redispersion of the treated fibrids may also vary within wide limits.

If water is used as auxiliary medium in the manufacture of the fibrids or for mechanical disentangling of the crude fibers, then the dispersing agent of the invention may be applied to the fibrids at this stage.

It is a special feature of the present invention that very small amounts of said substances are sufficient to cause fine dispersion of the hydrophobic polyolefin fibrids in water. Rates of application of more than 2% by weight, based on the dry weight of the fibers, tend to be detrimental and uneconomical.

When the suspensions produced in the process of the invention are used for the manufacture of webs on paper- or web-making machines, no foaming occurs. The webs of fibers may be readily removed from the wires of the machines.

The fibrids prepared in the present invention are particularly suitable for the manufacture of blended webs containing said polyolefin fibrids and also cellulose fibers in a wide range of proportions. The resulting webs showing a similarity to paper or textile webs are distinguished by very good fiber-bonding and good initial wet strength.

In the following, the parts and percentages are by weight.

The initial wet strength is that determined using a tester developed by W. Brecht and H. Fiebinger (see Karl Frank, Taschenbuch der Papierprufung, 3rd Amplified Edition, Eduard Roether Verlag, Darmstadt, 1958, p. 59.). Specimen strips measuring 30 × 95 mm are prepared from the fibers or fiber mixtures to be tested in a webforming device by the use of a frame. The thickness of the test strips (weight per unit area) is governed by the solids concentration of the suspension. The testing apparatus is then used to determine the load, in grams, at which the test strips tear. Since the results depend not only on the weight per unit area but also, to a marked degree, on the water content of the fibers, the latter must be determined for each test.

The following data on the initial wet strength refer to test strips having a water content of from 83 to 84% by weight.

PREPARATION OF A MELAMINE/FORMALDEHYDE POLYCONDENSATE

A mixture of 2,610 parts of 40% formaldehyde solution having a pH of 8, 1,783 parts of melamine and 249 parts of water are heated at 85°C. The resulting resin solution is heated at this temperature until a sample clouds when mixed with 5 parts of boiling water and allowed to cool to 50°C. At this point, 477 parts of caprolactam and 292 parts of a 50% caustic soda solution are added. Condensation is continued at a pH of from 7.5 to 8.0 at a temperature of from 82° to 85°C until a sample has a viscosity of 40 centipoise at 20°C after dilution with water to a solids content of 30%. The mixture is then diluted with water to a solids content of 30% and cooled to room temperature.

There is produced a polycondensate in which the molar ratio of melamine to formaldehyde to sodium aminocapronate is approx. 1:2.5:0.3.

MANUFACTURE OF FIBRIDS OF LOW-DENSITY POLYETHYLENE

A branched-chain polyethylene having a density of 0.918 g/cm$^3$, a melt index of 20 g/10 min (190 °C/2.16 kg) and a softening point of 105°C is melted in a twin-worm extruder. n-Pentane is added to the molten polymer through a metering pump such that the mixture extruded consists of a homogeneous polymer solution of 83% of n-pentane and 17% of polyethylene. This polymer solution is extruded through a circle of dies each having a diameter of 0.7 mm, the extrudate passing into a precipitating bath filled with water. Downstream of said dies and at a distance of 8 mm therefrom there is disposed a tube having a length of 15 cm and a diameter of 2.5 cm.

A jet of water having a velocity of 40 m/s is directed to this tube serving as impulse exchange chamber through a nozzle disposed in the center of the circle of dies and having a diameter of 2 mm. The temperature of the water is 18°C. The resulting pulp is freed from n-pentane by heating to 45°C and is then mechanically disentangled by treatment in an Ultra Turrax machine for 3 minutes at a solids content of 1.5% w/w. The resulting fibrids are finely fibrillated and their thickness ranges from 10 to 150 um and their length from 240 to 3,000 $\mu$m.

The fibers used in Examples 1 and 2 are such as have not been disentangled, whereas those used in Example 3 have been disentangled.

EXAMPLE 1

Dispersing action of various agents compared with a dispersing agent of the invention:

Use is made of the fibrids of polyethylene of low density as manufactured by the above method, which have been freed from n-pentane but not yet disentangled. The dispersing agents to be tested are added to the medium in which the fibers are disentangled.

For disentanglement of the fibers, 2 l of water and 1.0 g (0.34% w/w based on polymer) of dispersing agent as listed in Table 1 below are placed in a 3 l suction flask. 34 g (dry weight) of the hydrophobic crude fibers are then uniformly spread over the surface of the water. The shearing head of the disentangling apparatus (Ultra Turrax T 45/N, 380 W, 10,000 rpm) is then placed in the middle of the aqueous phase. After a disentangling time of 3 minutes, the apparatus is stopped and the rate at which the phases separate is determined. After a further 2 minutes, the height of the fiber-free liquid phase is measured. The results are listed in Table 1 below.

Table 1

| Comp. Example | Dispersing agent | Rate of phase separation [sec.] | Height of fiber-free liquid [mm] |
|---|---|---|---|
| 1 | ethylene oxide/propylene oxide polyadduct (SEPAROL 22) | 34 | 55 |
| 2 | p-nonylphenyl ethoxylate containing 10 ethylene oxide units | 32 | 55 |
| 3 | ethoxylated fatty acid ester (ZONYL A) | 27 | 45 |
| Example 1 | melamine/formaldehyde polycondensate of invention | no phase separation occurs | |

Surprisingly, the use of the modified melamine/formaldehyde resin provides complete and even dispersion of the fibrids in the aqueous phase. The fibrids are indeed wetted by the other dispersing agents, but they float to the top of the liquid phase.

EXAMPLE 2

Results obtained when using the aqueous polyolefin fibrid suspension in the production of sheets of paper, compared with polyolefin fibrid suspensions not of the invention:

The fibrids treated in Example 1 are filtered off and their moisture content is determined. For the preparation of a blended paper, 2 g (dry weight) of fibrids are dispersed in 1 l of water for 1 minute with stirring together with 2 g of sulfite cellulose (35°SR). The suspension of fibers is then passed to sheet-forming equipment containing 3 l of water.

The samples provided according to Comparative Examples 1 to 3 produce marked foaming. The fibers are not dispersed uniformly and the resulting sheets of paper show inconsistent distribution of matter and only poor fiber-bonding.

By contrast, the fibrids treated with the modified melamine/formaldehyde polycondensate in accordance with Example 1 disperse well in water without foaming to produce a blended paper showing uniform distribution of the fibers.

The blended paper (weighing about 130 g/m$^2$) shows good fiberbonding and has a initial wet strength of 105 g.

EXAMPLE 3

Preparation of a textile-like web structure 4 kg Of disentangled fibrids of a low-density polyethylene produced as described above are added to 100 l of water containing 40 g of dissolved modified melamine resin as described above, with stirring (propeller stirrer, approx. 800 rpm). Stirring is continued for 15 minutes, whereupon the treated fibrids are separated by filtration.

The fibrids, thus rendered hydrophilic, are then placed in 8 m$^3$ of water with stirring together with 4 kg of rayon staple fibers (1.7 dtex, chopped length 9 mm). Stirring for 20 minutes produces a homogeneous pulp. No foaming occurs. This pulp is fed to a webforming machine to produce a uniform textile-like web structure.

Similar tests carried out with the dispersing agents stated in Comparative Examples 1 and 2 show marked foaming on preparation of the mush of fibers. The dispersing action of these agents is inadequate.

Production of fibrids of a high-density polyethylene

A linear polyethylene having a density of 0.96 g/cm$^3$, a melt index of 4.5 g/10 min. (190°C/2.16 kg) and a softening point of 135°C, is dissolved in petroleum ether (b.p. 65°–95°C, density 0.96 g/cm$^3$) in a stirred vessel at a temperature of 150°C. The solution, containing 6% by weight of polymer, is passed through a 4 mm tube to be relaxed in a tank containing petroleum ether. The resulting crude fibers are disentangled for 3 minutes by high-frequency treatment in an Ultra Turrax machine (390 W, 10,000 rpm) at a solids content of 1.5% 1.5% petroleum ether. The fibrids are filtered off and freed from residual petroleum ether by heating in a stream of nitrogen at 50°C. The resulting fibrids have a very fine texture and are thin and crimped. They are similar to cellulose fibers. The fibrids thus obtained are used in Examples 4 and 5 below.

EXAMPLE 4

The fibrids of high-density polyethylene obtained as described above are treated with the dispersing agents given in Comparative Examples 1 and 3 and are then used, together with cellulose, for the manufacture of sheets of paper.

Treatment 40 g Of fibrids are stirred into 1 l of water containing 0.4 g (1% w/w based on dry fibers) of a dissolved dispersing agent. Stirring is continued for 20 minutes and the whole is allowed to stand overnight. The fibrids are then removed by filtration and their moisture content is determined.

Manufacture of sheets of blended paper 2 g Of the treated fibrids and 2 g of a sulfite cellulose (35° SR) are dispersed in water as described in Example 2 and then passed to a sheet-forming machine.

Observations and the results of measurements are listed in the following Table.

TABLE

| | Comp.Ex.1 | Comp.Ex.2 | Comp.Ex.3 | Example 1 |
|---|---|---|---|---|
| Behavior in sheet producer | | | | |
| foaming | yes | yes | yes | no |
| agglomeration | yes | yes | yes | no |
| addition of anti-foamer necessary | yes+ | yes+ | yes+ | no |
| Assessment of paper produced | | | | |
| fiber-bonding distribution | poor uneven | poor uneven | poor uneven | very good even |
| Initial wet strength | | | | |
| 50% fibrids | 102 g | 125 g | 121 g | 210 g |

+To destroy the foam, it was necessary to add from 2 to 3 c.c of a 10% solution of an antifoaming agent.

For comparison, sheets of paper showing other proportions of cellulose are prepared, their weight remaining the same at about 130 g/m$^2$ . The initial wet strengths of these papers are as follows:

| | Dispersing agent of Comp. Ex. 1 | Dispersing agent of Example 1 |
|---|---|---|
| 70% fibrids | 61 g | 160 g |
| 30% fibrids | 163 g | 250 g |

EXAMPLE 5

The fibrids of polyethylene are treated with 1% w/w (based on dry fibers) of the melamine/formaldehyde polycondensate in the manner described in Example 4. Said treated fibrids are capable of forming a paper-like web structure of 100% polyethylene fibrids without foaming or agglomeration. The webs show a uniform structure. A web weighing 130 g/m$^3$ shows an initial wet strength of 65 g.

We claim:

1. A process for the manufacture of aqueous suspensions of polyolefin fibrids by dispersing polyolefin fibrids in water in the presence of a dispersing agent, wherein the dispersing agent used is 0.1 to 2% by weight, based on the dry weight of said fibrids, of a melamine/formaldehyde/aminocarboxylic acid alkali metal salt polycondensate produced by polycondensation of monomers consisting of melamine, formaldehyde and an alkali metal salt of an aminocarboxylic acid in aqueous solution in a molar ratio of melamine to formaldehyde of from 1:1.8 to 1:3 and 0.1 to 0.5 mole of said alkali metal salt per mole of melamine, which polycondensate has a viscosity of from 10 to 120 centipoise at 20°C in 30% w/w aqueous solution.

2. A process as claimed in claim 1, wherein the aqueous suspensions of polyolefin fibrids additionally contain cellulose fibers.

* * * * *